US005325751A

United States Patent [19]

Green et al.

[11] Patent Number: 5,325,751

[45] Date of Patent: Jul. 5, 1994

[54] GANG RIP SAW ASSEMBLY

[75] Inventors: Max A. Green, New Hope; Marvin W. Lee, Blaine, both of Minn.

[73] Assignee: Mereen-Johnson Machine Company, Minneapolis, Minn.

[21] Appl. No.: 18,113

[22] Filed: Feb. 17, 1993

[51] Int. Cl.[5] ..... B27B 5/34

[52] U.S. Cl. ..... 83/13; 83/425.4; 83/504.508.3; 83/698.61

[58] Field of Search ..... 83/13, 425.4, 504, 508.2, 83/508.3, 698, 700

[56] References Cited

U.S. PATENT DOCUMENTS

| | | | |
|---|---|---|---|
| 1,390,958 | 9/1921 | Hulbert . | |
| 2,440,158 | 4/1948 | Sly . | |
| 3,202,189 | 8/1965 | Pearson . | |
| 3,630,244 | 12/1971 | Cromeens et al. | 83/508.2 |
| 3,703,915 | 11/1972 | Pearson | 83/824 |
| 3,865,000 | 2/1975 | Stafford | 83/504 X |
| 4,365,530 | 12/1982 | Johnson, Jr. et al. | 83/490 |
| 4,414,875 | 11/1983 | Pearson | 83/508.3 |
| 4,592,259 | 6/1986 | Görner et al. | 83/13 |
| 4,781,668 | 11/1988 | Mowry | 83/508.3 X |
| 5,036,741 | 8/1991 | Scott | 83/508.2 |

FOREIGN PATENT DOCUMENTS

| | | | |
|---|---|---|---|
| 315594 | 11/1971 | U.S.S.R. . | |
| 463541 | 6/1975 | U.S.S.R. | 83/425.4 |
| 472787 | 9/1975 | U.S.S.R. | 83/425.4 |

*Primary Examiner*—Eugenia Jones
*Attorney, Agent, or Firm*—Faegre & Benson

[57] ABSTRACT

Apparatus for adjusting backlash out of a positioning assembly for shaft mounted ring useful in multiple rip saw machinery and for minimizing arbor length. A pair of axially oriented straps secured to the ring and positioned along the shaft for axially positioning the ring on the shaft wherein a radial pin carried by the ring is eccentrically rotatable in a mating aperture in one of the straps to adjust backlash between the straps and the ring out of the assembly when the pin is rotated. The saw hubs and respective saw adjusting collars are arranged in a semi-interleaved nesting relationship resulting in reduced arbor length.

26 Claims, 5 Drawing Sheets

GANG RIP SAW ASSEMBLY

BACKGROUND OF THE INVENTION

This invention relates to the field of adjustable rip saws, of the type having a plurality of blades mounted on and driven by a common shaft and individually positionable axially on the shaft with respect to one another by respective saw adjusting collars located axially remote from the saw blades along the shaft. More particularly, in one aspect, this invention relates to an arrangement in a "semi-interleaved" nesting relationship of saw adjusting collars each respectively coupled to a saw hub to reduce the length of the shaft on which the collars and hubs are mounted. In another aspect, this invention relates to apparatus for adjusting backlash out of the positioning assemblies for such shaft mounted saws.

In the prior art it was known to "nest" respective pairs of saw adjusting collars and saw hubs as illustrated in FIG. 1. In FIG. 1, three saws 12, 14, 16 are mounted on a shaft or arbor 18. Shaft 18 is journalled for rotation about axis 20 in a machine frame (not shown) by suitable bearings, one of which (21) is shown schematically. Shaft 18 carries saw hubs 22, 24, 26 each of which is keyed to shaft 18 for rotation therewith. It is to be understood that the keys in hubs 22, 24, 26 are free to move axially along shaft 18, while providing for a rotational driving relationship between the shaft and each hub. A saw adjusting collar 34 is preferably close coupled to hub 22 to enable positioning of saw 12 axially on shaft 18. A first remote saw adjusting collar 48 is mechanically coupled to hub 24 as indicated by connection 42, shown in simplified form. Similarly, a third saw adjusting collar 58 is coupled to saw hub 26 by a mechanical connection 54 (also shown in simplified form). It is to be understood that it has been found desirable in certain instances to have a fixed saw 56 mounted at the center line of the rip saw machine (not shown) and to provide for adjustability of saws 12, 14, 16 towards and away from the machine center line, as illustrated, for example, by the phantom position of saw 16 and hub 26 located adjacent saw 56. To accomplish this, saw adjusting collar 58 is moved from the position shown in solid lines to that shown in phantom in FIG. 1. To permit such adjustability, it has been known to have a relatively long shaft or arbor 18, because the prior art utilized an "enclosing nesting" configuration. In an enclosing nesting configuration (as that term is used herein) the collar-hub pair 34, 22 is enclosed in a nesting relationship within collar-hub pair 48, 24 and those two collar-hub pairs are completely enclosed by (or trapped between) the collar-hub pair 58-26, all as illustrated in FIG. 1. Connection 42 is preferably sized to permit axial movement of saw 12 between collar 48 and hub 24, and connection 54 is preferably sized to permit movement of the enclosed saws 12, 14 and to permit movement of saw 16 over the range indicated between the solid and phantom positions shown. Such an arrangement requires an extremely long shaft 18 with consequent increase in expense, difficulty in manufacture and potential vibration problems.

DETAILED DESCRIPTION

Figure 1:
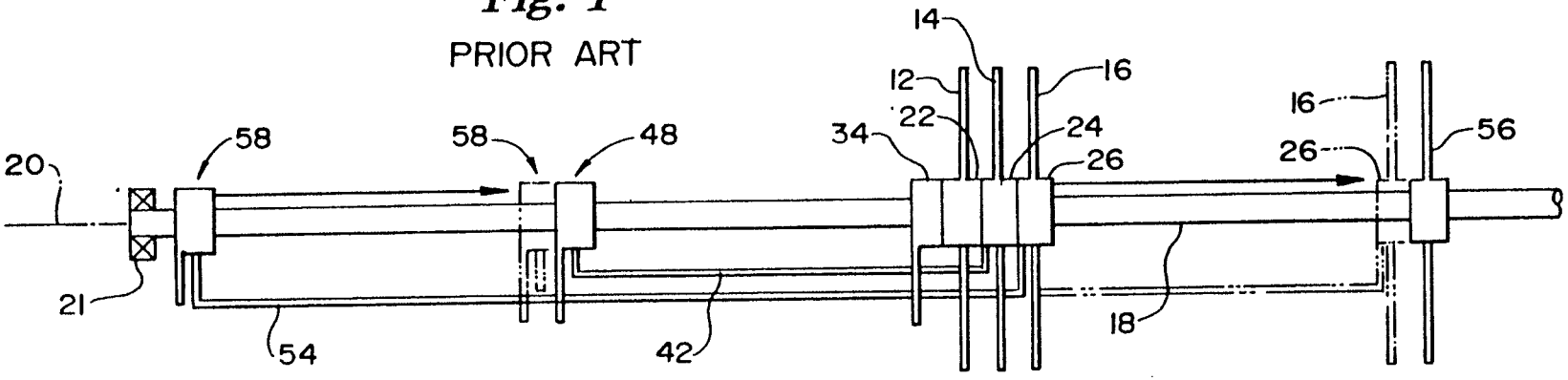
Fig. 1 PRIOR ART
FIG. 1 is a simplified plan view of a prior art arrangement of a gang rip saw apparatus.
Figure 2:
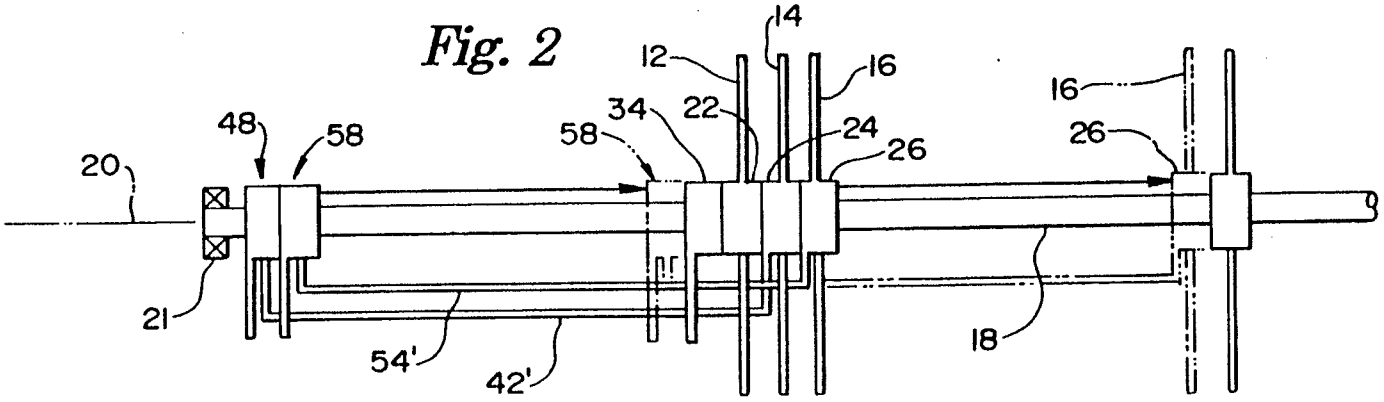
FIG. 2 is a simplified plan view of a gang rip saw apparatus arrangement of the present invention.

Referring now to FIG. 2, especially comparing it to FIG. 1, it has been found that utilizing a "semi-interleaved" in place of an enclosing nesting relationship permits shaft 18 to be substantially shortened, resulting in cost savings, improved manufacturability, and reduced potential for vibration problems. In the configuration shown in FIG. 2, collar 48 is located outboard of collar 58, resulting in the semi-interleaved configuration for collar-hub pair 58-26 (with respect to collar-hub pair 48-24). As may be seen, the range of adjustment of saws 12, 14, 16 in the semi-interleaved configuration shown in FIG. 2 is the same as that shown in FIG. 1, and is accomplished with substantially reduced arbor length (over that needed with an enclosing nesting configuration).

In the configuration shown in FIG. 2, the first and second saw adjusting collars 48, 58 are mounted on arbor 18 in a proximal region thereof. The first and second saw hubs 24, 26 mounted on arbor 18 are located in a region distal of collars 48, 58. Each saw hub is keyed in a driving relationship with arbor 18 for supporting and rotatingly driving, respectively, rip saw blades 14 and 16. The first connection or securing means 42' rigidly secures the first saw adjusting collar 48 to the first saw hub 24 while permitting axially movement of collar 48 and hub 24 together along arbor 18. The second mechanical connection or securing means 54' rigidly secures the second saw adjusting collar 58 to the second saw hub 26 while permitting axial movement of the second saw adjusting collar 58 and second saw hub 26 together along arbor 18 (as shown by the phantom position for collar 58 and hub 26). Finally, in the configuration shown in FIG. 2 an axially movable close-coupled saw assembly made up of collar 34 and hub 22 carries saw 12 and is mounted on arbor 18 and located intermediate an adjusting collar group formed by the first and second saw adjusting collars 48, 58 and a saw hub group formed by the first and second saw hubs 24, 26. In this configuration the first saw hub 24 is located intermediate the close-coupled saw assembly and the second saw hub 26 and the second saw adjusting collar 58 is intermediate the close-coupled saw assembly and the first saw adjusting collar 48. It is to be understood that in both the prior art arrangement of FIG. 1 and in the practice of the present invention (for example as shown in FIG. 2) that the fixed saw 56 is optional and may or may not be used.

It may be noted that in the improved configuration shown in FIG. 2, the first and second saw adjusting collars 48, 58 are located generally axially adjacent each other when the first and second saw hubs 24, 26 are positioned axially adjacent each other.

Figure 3:
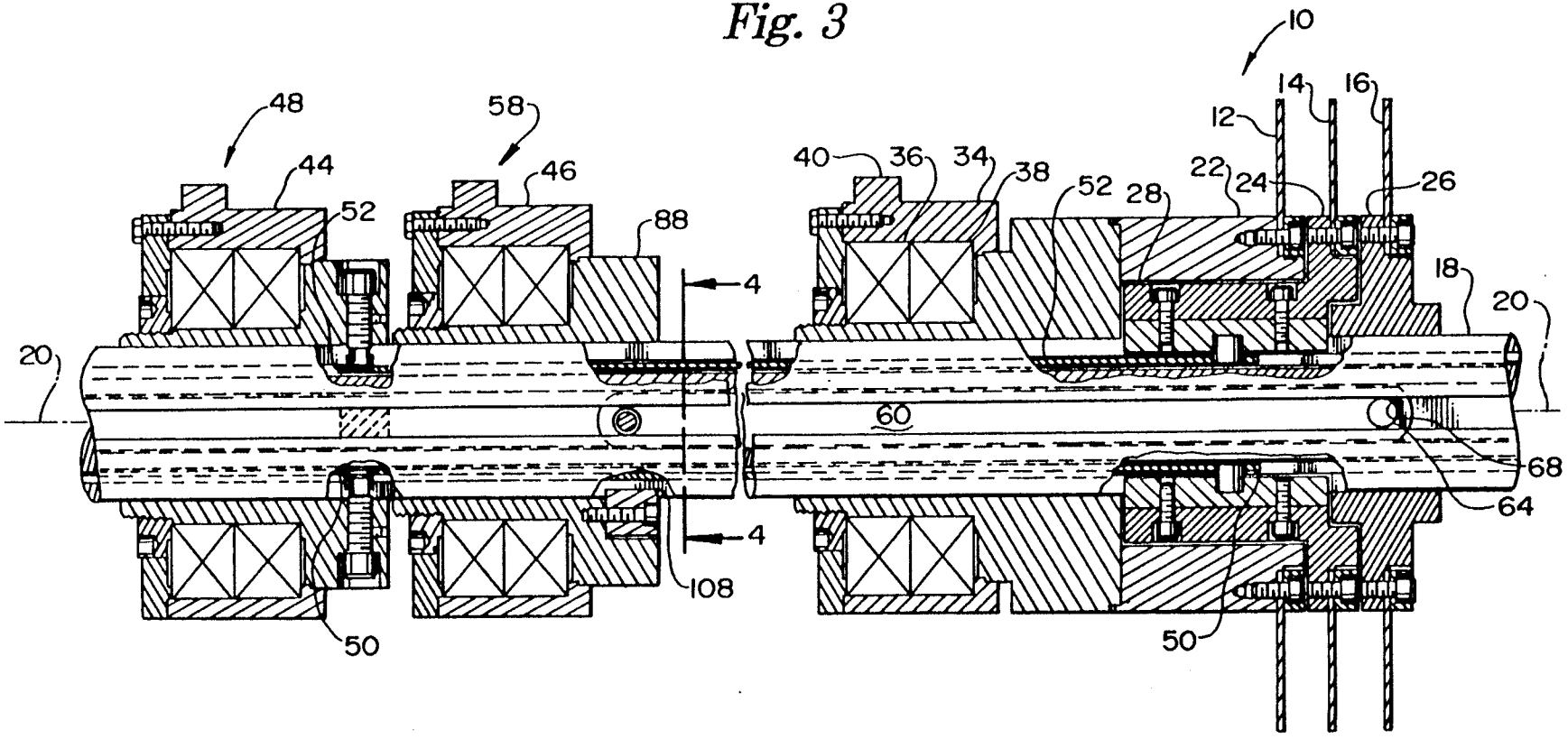
FIG. 3 is a partial section view of a gang rip saw apparatus having three saws controlled by individual saw adjustment assemblies taken along line 3—3 of FIG. 4.

Connection 42' serves as both securing and spacing means and in addition to securing the saw adjusting collar 48 to hub 24, it spaces collar 48 axially apart from hub 24 while at the same time forming a rigid assembly which is axially movable along arbor 18. Similarly, connection 54' serves as spacing means as well as securing means between collar 58 and hub 26, again securing them together in a rigid assembly also axially movable along arbor 18. Referring now to FIG. 3 (which omits fixed saw 56), a partial section top view of an embodiment of the present invention may be seen in more detail. Gang rip saw assembly or apparatus 10 is shown with the three saws 12, 14, 16 mounted on shaft 18. Shaft 18 carries respective saw hubs 22, 24, 26 each of which is keyed to shaft 18. A key 28 for hub 24 is shown in FIG. 3, while keys 30 and 32, for, respectively, hubs 22 and 26, may be seen in FIG. 10. It is to be understood that keys 28, 30, 32 provide a driving connection in the direction of rotation between shaft 18 and the respective hubs 22, 24 and 26 to drive saws 12, 14, 16 when shaft 18 rotates. Saw adjusting collar 34 is non-rotating and is carried by bearings 36, 38 on hub 22. Collar 34 has a radial projection 40 to enable axial positioning by a shifter apparatus (not shown) which preferably moves the collar 34 and hub 22 axially to a desired positioned along shaft 18 to locate saw 12 with respect to a work piece (not shown). The shifter apparatus is conventional and forms no part of this invention. A second collar 44, and a third collar 46 are connected, respectively, to hubs 24 and 26 to position saw blades 14 and 16 respectively. Collar 44 is a part of a first remote saw adjusting assembly 48 axially coupled to hub 24 via a pair of straps 50, 52. Third collar 46 is part of a second remote saw adjustment assembly 58 and is axially coupled to hub 26 via a pair of straps 60, 62.

It is to be understood that collar 34 controls the position of saw 12 along axis 20, while collar 44 controls the position of saw 14 and collar 46 controls the position of saw 16 axially along axis 20. In saws of this type, it is preferable to have a second assembly (not shown) that is a mirror image of assembly 10 also mounted on shaft 18 (to the right of assembly 10 as shown in FIGS. 2 and 3) to provide a total of six adjustable saws.

In gang rip saws, it is highly desirable to have very precise control of the axial position of each saw blade to provide highly controllable and repeatable cutting. In the past it has been found difficult to provide for precise saw positioning via remote collars because of looseness or backlash between the collar and the saw assembly. The present invention overcomes difficulties experienced in the prior art by providing apparatus for adjusting the backlash out of the positioning assembly for shaft mounted rings on which the saws may be secured.

Figure 6:
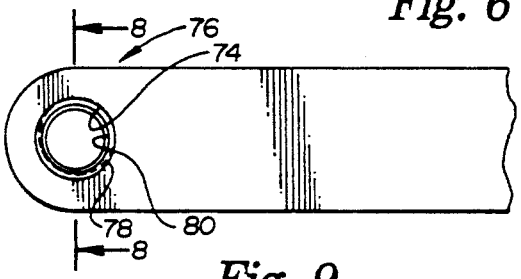
FIG. 6 is a bottom plan view of a adjusting strap useful in the practice of the present invention.
Figure 6:
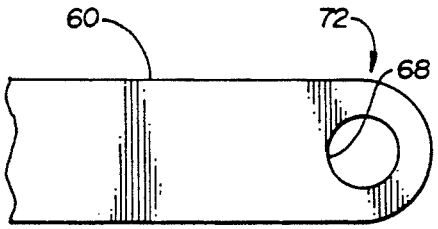
Figure 10:
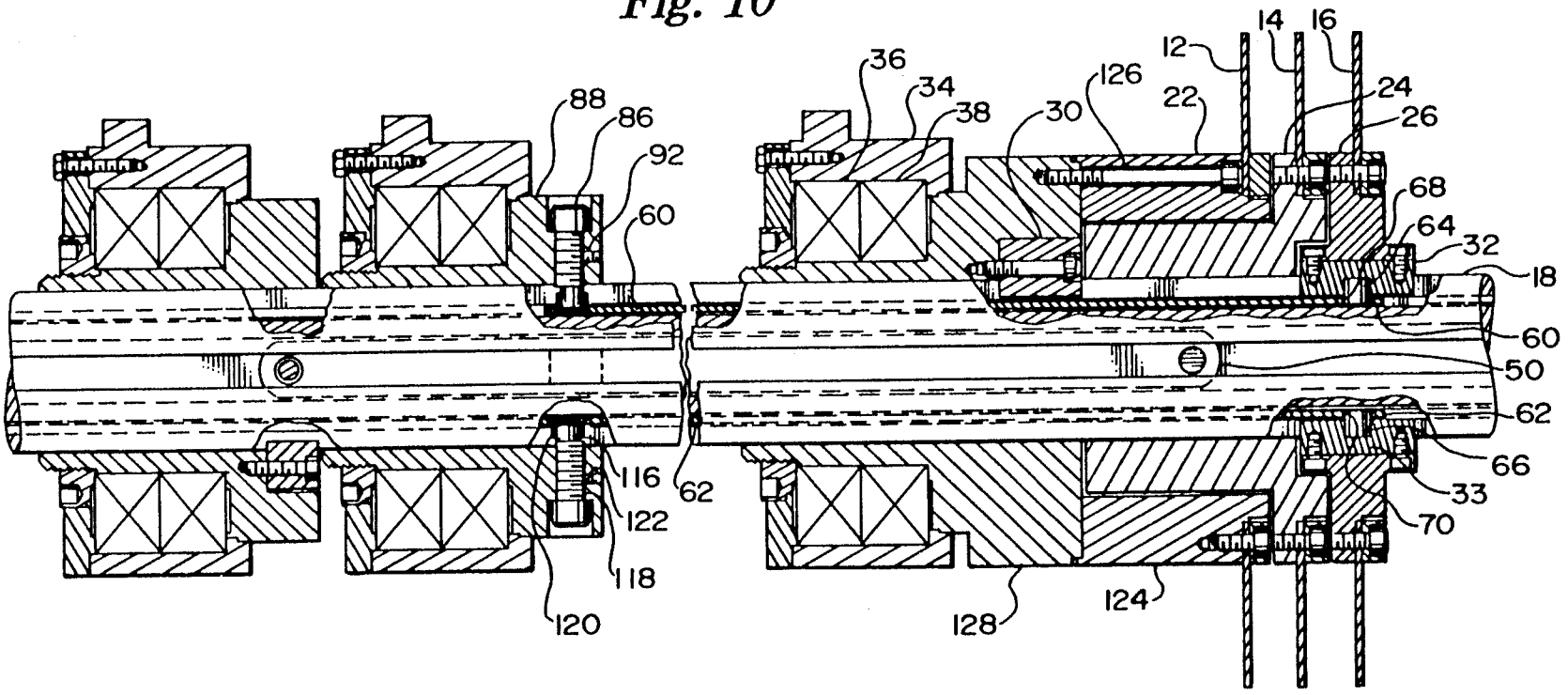
FIG. 10 is a section view taken along line 10—10 of FIG. 4.

Referring now also to FIG. 10, straps 60 and 62 are secured to saw hub 26 via pins 64, 66 which are press fit in keys 32, 33. Pins 64, 66 are preferably respectively received in bores 68, 70 in straps 60, 62. It is to be understood that bores 68 and 70 are preferably closely interfit with pins 64, 66. Referring now also to FIG. 6, it is to be understood that bore 68 is located at the proximal end 72 of strap 60, while a second bore 74 is located at a distal end 76 of strap 60.

Figure 9:
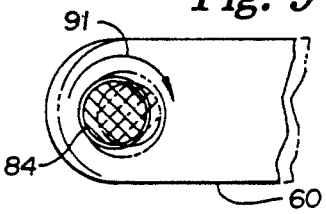
FIG. 9 is a fragmentary view of a distal end of the strap of FIG. 6 showing the operation of the pin 84 in adjusting the position of strap 60.
Figure 8:
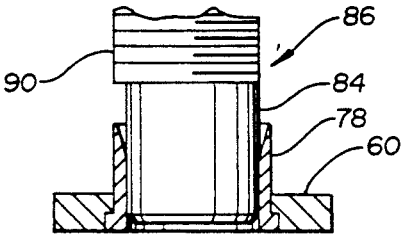
FIG. 8 is an assembly view in section of a strap, bushing and eccentric pin subassembly of the present invention taken along line 8—8 of FIG. 6.
Figure 7:
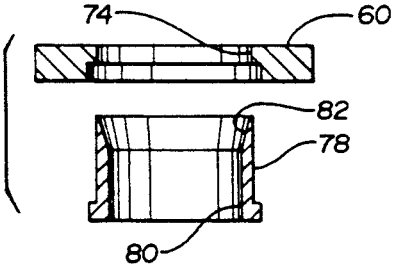
FIG. 7 is an exploded section view of a strap and bushing shown in section.

Referring now more particularly to FIGS. 7 and 8, bore 74 may be stepped as shown in FIG. 7 to matingly interfit with a press-fit bushing 78. Bushing 78 has a through bore 80 and a cone-shaped entry portion 82. Bore 80 is sized to slidingly receive a pin 84. Pin 84 is preferably carried as an eccentric extension of a threaded member 86. Threaded member 86 may be a cap screw with an eccentric projecting pin formed integrally therewith as shown in FIG. 10. Member 86 is threadedly received in a rotating portion 88 of a saw adjusting assembly such as exemplified by the second remote saw adjusting assembly 58. Because pin 84 is eccentric with respect to the threaded portion 90 of member 86, strap 60 can be urged in a direction parallel to axis 20 by rotation of member 86, indicated by arrow 91, as illustrated in FIG. 9. As member 86 is rotated, any backlash present in the assembly of adjuster 58, hub 26 and strap 60 may be adjusted out by appropriate rotation of member 86. Referring to FIG. 10, a similar arrangement is provided for the assembly of adjuster 58, hub 26 and strap 62.

Figure 5:
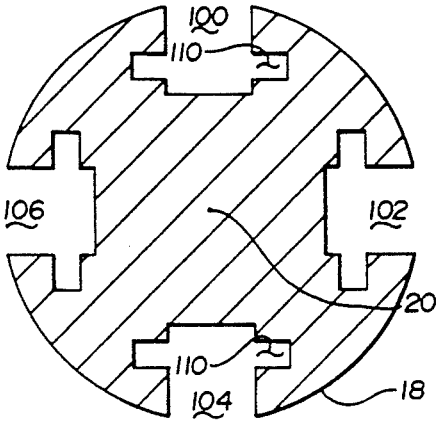
FIG. 5 is a section view of a shaft useful in the practice of the present invention.
Figure 4:
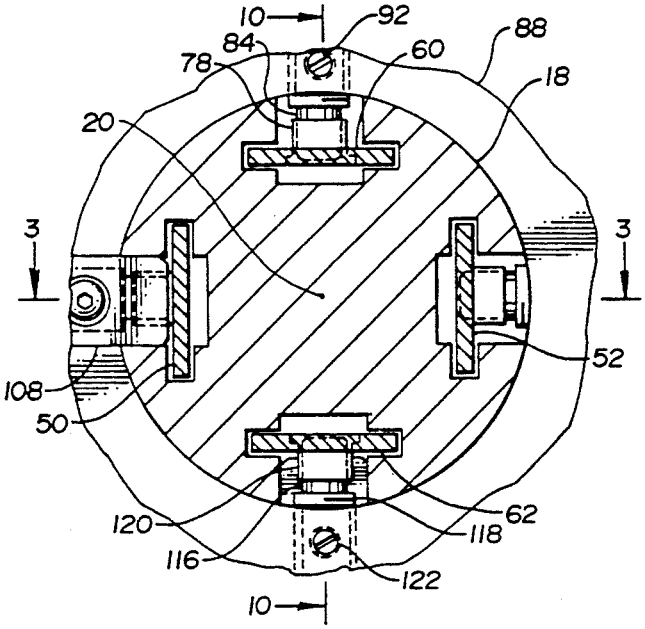
FIG. 4 is a section view taken along line 4—4 of FIG. 3.

Referring now also to FIGS. 4 and 5, shaft 18 is preferably provided with a plurality of keyways 100, 102, 104, 106 suitable for receiving appropriate keys such as key 108 shown in FIGS. 3 and 4. Each of the keyways in shaft 18 has an enlarged portion exemplified by enlarged portion 110 in keyway 100. Portion 110 is sized to accommodate strap 60 as illustrated in FIG. 4. It is further to be understood that the width of portion 110 is to be sufficient to permit strap 60 to be displaced transversely as pin 84 is rotated (as shown by arrow 91 in FIG. 9).

Referring now most particularly to FIGS. 3, 4, and 10, a set screw 92 is threadably received in portion 88 and arranged to engage threaded member 86 to serve as a locking means to prevent rotation of member 86 with respect to portion 88 once member 86 is adjusted to eliminate backlash.

Figure 11:
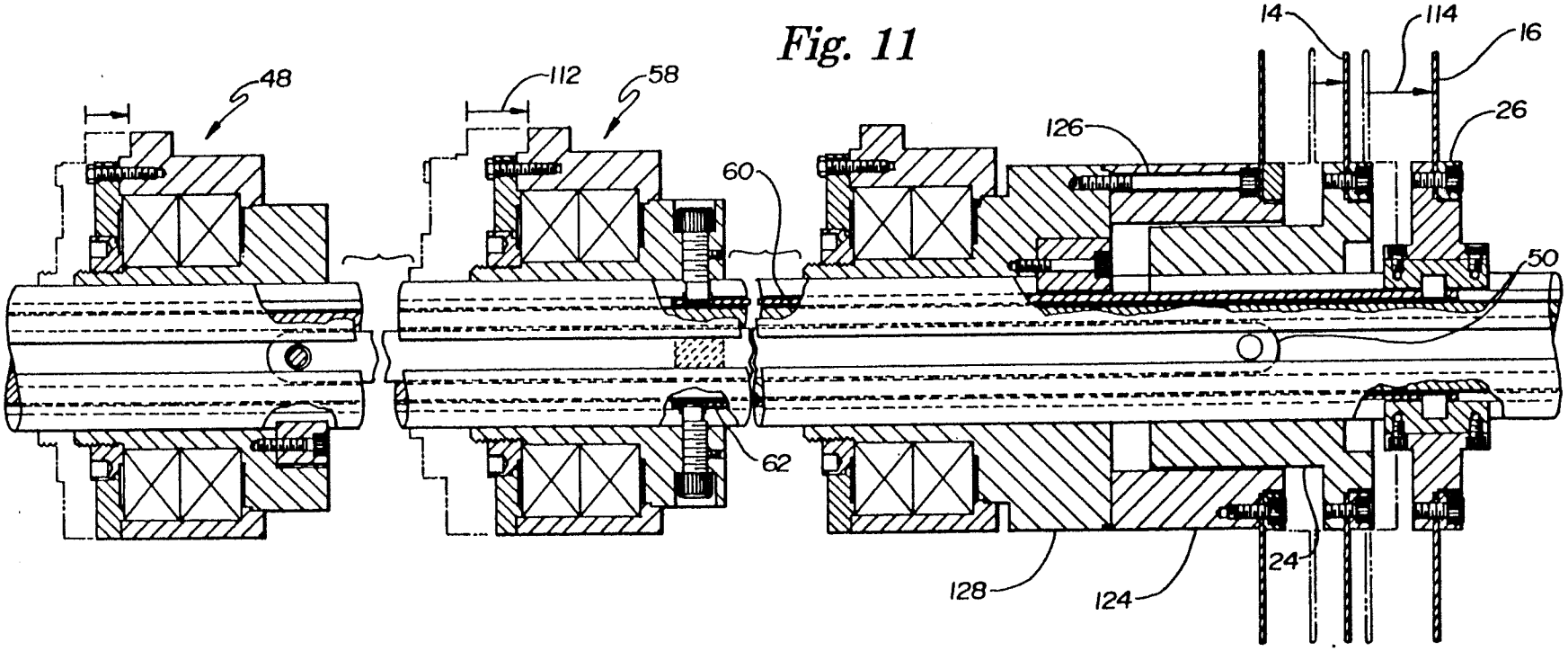
FIG. 11 is a view similar to FIG. 10 except with two saws axially displaced along the shaft in response to the displacement of the respective saw adjusting collars.

Referring now to FIG. 11, when adjuster 58 is moved a distance indicated by arrow 112, saw hub 26 and saw blade 16 will move an equal distance indicated by arrow 114 since hub 26 will be driven by straps 60, 62. Similarly, adjuster 48 will move saw 14 via the action of straps 50, 52.

It has been found that the movement of saws 14 and 16 in response to movement of the respective saw adjusters 48, 58 is precise and repeatable once backlash of the respective overall assembly has been eliminated by adjustment of the threaded members engaging the bushing in the distal ends of the respective straps of that assembly. It has further been found that locking the threaded members by means of the set screws (such as for example set screw 92 acting on threaded member 86) will preserve the original settings.

It may thus be seen that apparatus 10 is useful for adjusting backlash out of a positioning assembly for a shaft mounted ring such as hub 26 mounted on shaft 18 which is journalled for rotation about the cylindrical axis 20 in a machine frame. Ring 26 is mounted on shaft 18 and is axially movable along shaft 18. An adjuster mechanism 58 is mounted on shaft 18 and located axially remote from ring 26. There are (preferably) two axially oriented straps 60, 62 positioned along shaft 18 and securing ring 26 to adjuster 58 for axially positioning ring 26 by moving the adjuster 58 along shaft 18. A radially oriented pin 84 is carried by adjuster 58 and is rotatable for eccentric movement with respect thereto. Pin 84 is received in a mating aperture 80 in a bushing 78 in the strap 60 to adjustably secure the strap 60 to the adjuster 58 such that when pin 84 is rotated by member 86, backlash between the strap 60 and the adjuster 58 is adjusted out by eccentric movement of the pin 84 with respect to the adjuster 58. The other end of strap 60 has an aperture or bore 68 which receives a fixed pin or dowel 64 which connects strap 60 to hub 26. Alternatively, pin 84 may be carried in ring 26 instead of in rotating portion 88 of adjuster 58. In such an alternative where the adjustable pin is in hub 26, the fixed pin will be in portion 88. As a further alternative, bushing 78 may be omitted and pin 84 may be received directly in aperture or bore 74 in strap 60. A locking means such as set screw 92 has been found to be desirable to selectively lock pin 84 extending from threaded member 86 against unwanted eccentric movement once backlash has been adjusted out of the assembly. It is further been found desirable to have a second strap 62 and a second radially oriented pin 116 carried by ring 88. Pin 116 is preferably formed integral with and adjustable via the second threaded member or cap screw 118. Second pin 116 is received in second bushing 120 pressed into second strap 62. Alternatively, second bushing 120 may be omitted and pin 116 may be received directly in an aperture of second strap 62. A second locking set screw 122 is provided to secure cap screw 118 against undesired rotation. Keyways 100, 104 each have an axially oriented recess 110 in shaft 18 in which straps 60 and 62 are received (see FIGS. 2 and 3). Recesses 110 have a width sufficient to permit lateral movement of the strap within the recess in response to eccentric movement of the pin engaged with the strap.

Shaft 18 may be considered to be a generally cylindrical arbor having a principal axis 20 journalled on a machine frame (not shown) for rotation about axis 20. In addition to the first saw adjusting collar 48 mounted on arbor 18 in a proximal region thereof, the first saw hub 26 may be considered to be mounted on arbor 18 in a distal region thereof and keyed in driving relationship with arbor 18 via keys 32 and 33 for supporting and rotatingly driving rip saw blade 16. Straps 60, 62 make up a first pair of straps extending from the first collar 58 to the first hub 26 with each strap secured to the first hub 26 by first fastening means such as pins 64, 66 for preventing axial motion between the first hub 26 and straps 60, 62, respectively along the arbor. The second fastening means 86 adjustably secures strap 60 to the first collar 58 while providing a limited amount of axial motion between strap 60 and the collar 58 such that backlash in the collar 58, strap 60, and hub 26 may be adjusted out by adjusting the second fastening means 86 to axially move the collar 88 with respect to strap 60. The second fastening means includes threaded member 86 and also further includes the locking means or set screw 92 which is located in contact with the threaded member 86 for locking the second fastening means at a position wherein the backlash is adjusted out.

Referring now again to FIGS. 10 and 11, it may be seen that first saw hub 24 and close-coupled saw hub 22 may be telescoped together with saw hub 22 preferably in the form of an annular ring 124 secured by a plurality of fasteners such as cap screws 126 to a base portion 128.

The invention is not to be taken as limited to all of the details thereof as modifications and variations thereof may be made without departing from the spirit or scope of the invention; for example, while hub 26 is shown to be symmetrical, it may be made asymmetrical with a radially inner portion extended axially, similar to that shown for hub 24.

What is claimed is:

1. A method of adjusting backlash out of a positioning assembly for a shaft-mounted saw hub comprising the steps of:

a) threadably engaging a threaded member in a shaft-mounted ring radially-inwardly wherein the threaded member has an eccentric pin extending from a radially inward end thereof;

b) receiving the eccentric pin in an aperture of an axially oriented ring positioning strap to adjustably secure the strap to the ring; and c) rotating the threaded member through a partial revolution while the pin is engaged with the strap to adjust out backlash between the strap and the ring.

2. The method of claim 1 further comprising the additional step of:

d) locking the threaded member against further rotation after the backlash has been adjusted out.

3. Apparatus for adjusting backlash out of a positioning assembly for a shaft-mounted ring comprising:

a) a shaft journalled for rotation about a cylindrical axis in a machine frame;

b) a ring mounted on the shaft and axially movable along the shaft;

c) a pair of axially oriented straps positioned along the shaft and secured to the ring for axially positioning the ring on the shaft; and d) a radially-oriented pin carried by the ring and rotatable for eccentric movement with respect thereto and wherein the pin is received in a mating aperture in one of said pair of straps wherein at least said one strap is adjustably secured to the ring by the pin such that when the pin is rotated, backlash between the pair of straps and the ring is adjusted out by the eccentric movement of the pin with respect to the ring.

4. The apparatus of claim 3 further comprising a bushing secured to the one strap wherein the mating aperture for the pin is formed by the bushing.

5. The apparatus of claim 3 further comprising a second radially-oriented pin carried by the ring and rotatable for eccentric movement with respect thereto, wherein the second pin is received in a mating aperture in the other strap.

6. The apparatus of claim 5 further comprising a pair of axially oriented recesses in the shaft and wherein the straps are received in the recesses.

7. The apparatus of claim 6 wherein the recesses have a width sufficient to permit lateral movement of each of the pair of straps without binding in the shaft in response to the eccentric movement of the respective pin received in the mating aperture in respective strap.

8. Assembly for eliminating backlash in multiple rip saw positioning apparatus comprising:

a) a generally cylindrical arbor having a principal axis and journalled on a machine frame for rotation about the principal axis;

b) a first saw adjusting collar mounted on the arbor in a proximal region thereof and having a non-rotating first portion journalled on a rotatable second portion;

c) a first saw hub mounted on the arbor in a distal region thereof and keyed in a driving relationship with the arbor for supporting and rotatingly driving a rip saw blade;

d) a first pair of straps extending from the first collar to the first hub wherein each strap is secured to the first hub by first fastening means for preventing axial motion between the hub and the straps along the arbor; and e) second fastening means for adjustably securing at least one of the first pair of straps to the first collar while providing a limited amount of axial motion between the one strap and the first collar such that backlash in the first collar, the first pair of straps and the first saw hub is adjusted out by adjusting the second fastening means to axially move the first collar with respect to the one strap.

9. The apparatus of claim 8 wherein the second fastening means further comprises locking means located thereon for locking the second fastening means at a position wherein the backlash is adjusted out.

10. The apparatus of claim 8 wherein the second fastening means comprises an eccentric pin adapted to be received in a mating aperture in the one strap.

11. The apparatus of claim 10 wherein the second fastening means further comprises a radially oriented threaded member threadedly received in the first collar and wherein the eccentric pin extends from a radially-inward end of the threaded member.

12. The apparatus of claim 11 wherein the second fastening means further comprises locking means located on the radially oriented threaded member for selectively locking the threaded member against rotation.

13. The apparatus of claim 12 wherein the locking means comprises a set screw threadedly received in the collar and engageable with the threaded member.

14. The apparatus of claim 8 wherein the arbor further comprises a first pair of axially extending, radially-inwardly indented recesses and wherein each of the first pair of straps is located in one of the first pair of recesses of the arbor.

15. The apparatus of claim 14 wherein the recesses are located diametrically opposite each other in the arbor.

16. The apparatus of claim 15 further comprising a second saw adjusting collar and associated second saw hub, each located outboard of the first collar and first hub on the arbor.

17. The apparatus of claim 16 wherein the arbor further comprises a second pair of recesses, with each recess of the second pair of recesses located diametrically opposite each other in the arbor.

18. The apparatus of claim 17 further comprising a second pair of straps connecting the second saw adjusting collar to the second saw hub.

19. The apparatus of claim 18 further comprising outboard first and second fastening means for fastening the second saw adjusting collar to the second saw hub and for adjusting out backlash in the second collar, the second pair of straps and the second saw hub.

20. The apparatus of claim 19 further comprising a third saw adjusting collar and closely coupled saw hub located intermediate the first saw adjusting collar and first saw hub on the arbor.

21. The apparatus of claim 8 wherein the second fastening means further comprises a pair of axially positionable pins, with one of said pins received in each strap.

22. The apparatus of claim 21 wherein each pin is received in a mating aperture in its respective strap.

23. The apparatus of claim 22 wherein the mating aperture is formed in a bushing retained in the respective strap.

24. Apparatus for minimizing arbor length in an adjustable multiple rip saw positioning assembly comprising:

a) a generally cylindrical arbor having a principal axis and journalled on a machine frame for rotation about the principal axis;

b) first and second saw adjusting collars mounted on the arbor in a proximal region thereof;

c) first and second saw hubs mounted on the arbor in a distal region thereof, said first and second hubs keyed in a driving relationship with the arbor and supporting and rotatingly driving first and second saw blades;

d) first securing means for rigidly securing the first saw adjusting collar to the first saw hub while permitting axial movement of the first saw adjusting collar and first saw hub together along the arbor;

e) second securing means for rigidly securing the second saw adjusting collar to the second saw hub while permitting axial movement of the second saw adjusting collar and second saw hub together along the arbor;

f) an axially movable close-coupled saw assembly formed by a close-coupled third saw, hub and third saw adjusting collar mounted on the arbor said saw hub supporting a third saw blade, said close-coupled saw assembly located intermediate an adjusting collar group formed by the first and second saw adjusting collars and a saw hub group formed by the first and second saw hubs;

wherein:

i) the first saw hub is located intermediate the close-coupled saw assembly and the second saw hub, and ii) the second saw adjusting collar is intermediate the close-coupled saw assembly and the first saw adjusting collar.

25. The apparatus of claim 24 wherein the first and second saw adjusting collars are located generally axially adjacent each other when the first and second saw hubs are positioned axially adjacent each other.

26. The apparatus of claim 24 wherein the saw hub of the close-coupled saw assembly further comprises an annular ring telescoping over a portion of the first saw hub to provide close axial spacing of the saw blades mounted on the first saw hub and the saw hub of the close-coupled saw assembly.

* * * * *

UNITED STATES PATENT AND TRADEMARK OFFICE

CERTIFICATE OF CORRECTION

PATENT NO. : 5,325,751

DATED : July 5, 1994

INVENTOR(S) : Max A. Green and Marvin W. Lee

It is certified that error appears in the above-indentified patent and that said Letters Patent is hereby corrected as shown below:

Column 8, Claim 24(f), line 39, between the words "said" and "saw" should be the word --third--.

Signed and Sealed this

Twenty-ninth Day of November, 1994

*Attest:*

Bruce Lehman

BRUCE LEHMAN

*Attesting Officer*

*Commissioner of Patents and Trademarks*